US008246412B2

(12) United States Patent
Tomono

(10) Patent No.: US 8,246,412 B2
(45) Date of Patent: Aug. 21, 2012

(54) MANUFACTURING METHOD FOR DISPLAY USING SURFACE TREATMENTS OF ADHESION SURFACES

(75) Inventor: Haruo Tomono, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 21 days.

(21) Appl. No.: 12/905,134

(22) Filed: Oct. 15, 2010

(65) Prior Publication Data

US 2011/0092126 A1 Apr. 21, 2011

(30) Foreign Application Priority Data

Oct. 20, 2009 (JP) ..... 2009-241597

(51) Int. Cl.
*H01J 9/26* (2006.01)

(52) U.S. Cl. ..... 445/25; 445/24; 427/217; 427/372.2

(58) Field of Classification Search ..... 445/24–25
See application file for complete search history.

(56) References Cited

U.S. PATENT DOCUMENTS

2004/0241323 A1* 12/2004 Ylitalo et al. ..... 427/258
2007/0044830 A1* 3/2007 Uemura ..... 136/251
2011/0007391 A1* 1/2011 Takahashi ..... 359/485

FOREIGN PATENT DOCUMENTS

JP 2000-053453 A 2/2000

* cited by examiner

*Primary Examiner* — Tracie Y Green
(74) *Attorney, Agent, or Firm* — Fitzpatrick, Cella, Harper & Scinto

(57) ABSTRACT

A manufacturing method for a display, in which a transparent plate is adhered to an outer surface of a screen provided on a display main body, includes the steps of setting the outer surface of the screen of the display main body and one surface of the transparent plate as respective adhesion surfaces, and performing a surface treatment at a peripheral edge region of one or both of the adhesion surfaces such that a surface energy of the peripheral edge region is smaller than a surface energy of a remaining region of the two adhesion surfaces and a surface energy of an adhesive used in the adhesion. The display main body and the transparent plate are disposed such that the two adhesion surfaces oppose each other via a gap, and the adhesive is injected into the gap. The surface treatment is performed within a width range of 1 mm to 3 mm from the edge regions of the adhesion surfaces.

10 Claims, 3 Drawing Sheets

MANUFACTURING METHOD FOR DISPLAY USING SURFACE TREATMENTS OF ADHESION SURFACES

BACKGROUND OF THE INVENTION

1. Field of the Invention

The present invention relates to a manufacturing method for a display in which a transparent plate for improving shock resistance, display performance, and so on, for example, is adhered to an outer surface of a screen provided on a display main body.

2. Description of the Related Art

A method disclosed in Japanese Patent Application Publication No. 2000-053453 is known as a method of adhering a transparent plate (sheet glass) for improving shock resistance, display performance, and so on to an outer surface of a screen provided on a display main body. In this method, an adhesive is applied to either one of the screen of the display main body or the transparent plate, whereupon the transparent plate, which is bent so as to project toward the screen of the display main body, is gradually adhered from one side thereof toward an opposite side while applying pressure with a roller.

SUMMARY OF THE INVENTION

However, in the method described in Japanese Patent Application Publication No. 2000-053453, a surface of the transparent plate is pressed against the screen of the display main body by the roller, and therefore a load is likely to act on the screen. The load applied to the screen of the display main body may cause a plate material constituting the screen to distort, thereby damaging the plate material itself and members on the inside thereof. Moreover, the transparent plate is easily damaged during the bending process and by the pressing load applied by the roller.

The present invention provides a manufacturing method for a display in which a transparent plate can be adhered to a screen of a display main body substantially without applying a load to the screen and the transparent plate.

The present invention provides a manufacturing method for a display in which a transparent plate is adhered to an outer surface of a screen provided on a display main body, comprising the steps of: setting the outer surface of the screen of the display main body and one surface of the transparent plate as respective adhesion surfaces, and performing a surface treatment in a peripheral edge region of one or both of the adhesion surfaces such that a surface energy of the peripheral edge region is smaller than a surface energy of a remaining region of the two adhesion surfaces and a surface energy of an adhesive used in the adhesion; disposing the display main body and the transparent plate such that the two adhesion surfaces oppose each other via a gap; and injecting the adhesive into the gap.

According to the present invention, the transparent plate can be adhered to the screen of the display main body substantially without applying a load to the screen and the transparent plate. Therefore, damage to the display main body and the transparent plate occurring when the transparent plate is adhered to the screen of the display main body can be prevented.

Further features of the present invention will become apparent from the following description of exemplary embodiments with reference to the attached drawings.

DESCRIPTION OF THE EMBODIMENTS

Figure 1A:
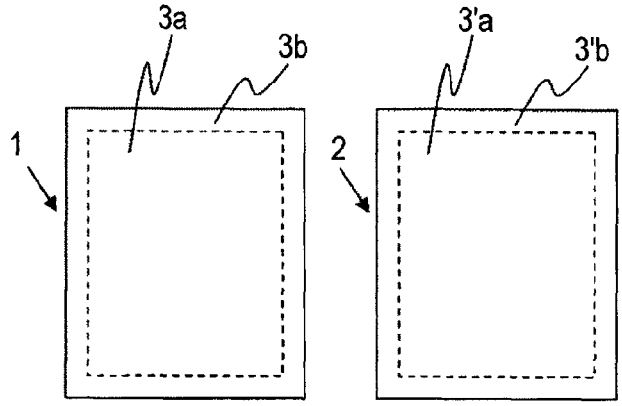
FIGS. 1A to 1F are schematic diagrams showing a process for adhering a transparent plate according to a first embodiment.

The present invention is applied to the manufacture of a flat panel display such as an electron beam display panel, a liquid crystal display panel, an EL display panel, or a plasma display panel, for example. The present invention may also be used to manufacture a cathode ray tube (CRT) display. Further, a display main body according to the present invention refers to a panel part constituting a screen in a flat panel display and a CRT part in a CRT display. The present invention will be described in detail below using manufacture of a flat panel display as an example.

First Embodiment

FIGS. 1A to 1F are schematic diagrams showing examples of a process for adhering a transparent plate to an outer surface of a screen provided on a display main body of a flat panel display in a first embodiment of the manufacturing method for a display according to the present invention. In the drawing, 1 denotes a display main body, 2 denotes a transparent plate, 3*a* and 3'*a* denote adhesion surfaces of the display main body 1 and the transparent plate 2, 3*b* and 3'*b* denote peripheral edge regions of the adhesion surfaces 3*a*, 3'*a*, 4 denotes a dispenser, 5 denotes an adhesive, and 6 denotes a nozzle of the dispenser 4.

Figure 2A:
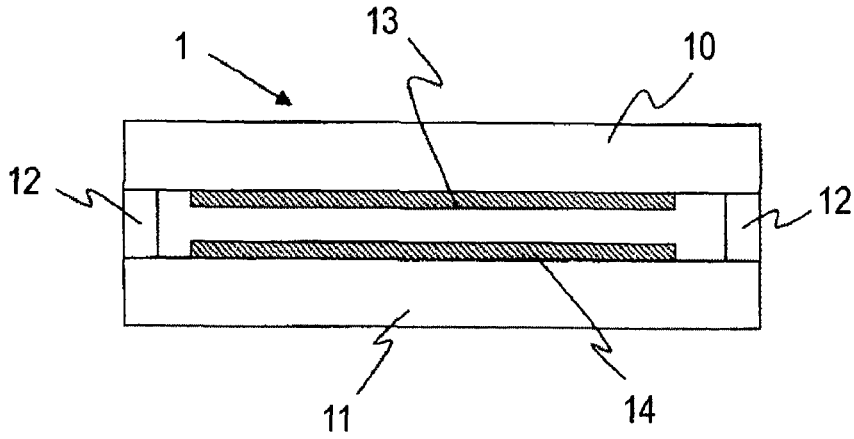
FIGS. 2A to 2D are schematic sectional views illustrating a display main body and the transparent plate.

As shown in FIG. 2A, the display main body 1 includes a display plate 10 constituting a screen, a rear plate 11 disposed on a rear surface side, and a frame 12 forming an airtight container together with the display plate 10 and the rear plate 11. Image display means is disposed in the airtight container. Taking an electron beam display panel as an example, the image display means is constituted by phosphor 13 disposed in the display plate 10, an electron source 14 disposed in the rear plate 11, and so on. Further, although not shown in the drawings, the image display means is constituted by liquid crystal, a transistor, an electrode, and so on in the case of a liquid crystal display panel, an EL element and so on in the case of an EL display panel, and phosphor, plasma generating gas, an electrode, and so on in the case of a plasma display panel.

Figure 2B:
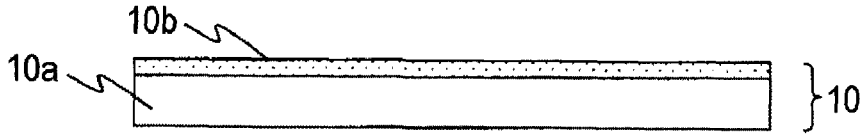
Figure 2C:
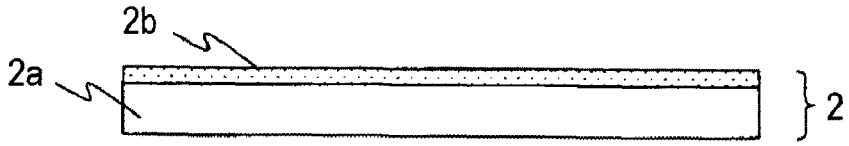
Figure 2D:
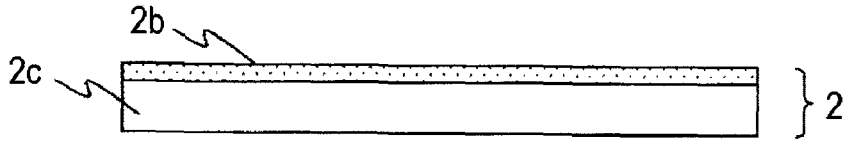

As shown in FIG. 2B, the display plate 10 forming the screen of the display main body 1 is constituted by a transparent glass 10*a* and a transparent resin film 10*b* adhered to a surface of the transparent glass 10*a*. Although not shown in the drawings, the display plate 10 may be constituted by the transparent glass 10*a* alone. The transparent resin film 10*b* is a resin film having an antistatic function, an anti-reflection function, a color filter function, and so on, for example. As shown in FIGS. 2C and 2D, the transparent plate 2 adhered to the outer surface of the screen is constituted by a transparent glass 2*a* or a transparent resin plate 2*c* and a transparent resin film 2*b* adhered to a surface thereof. Although not shown in the drawings, the transparent plate 2 may be constituted by the transparent glass 2*a* or the transparent resin plate 2*c* alone. As described above, the transparent resin film 2*b* is a resin film having an antistatic function, an anti-reflection function, a color filter function, and so on, for example. When the transparent resin film 10*b* is provided on the display plate 10 of the display main body 1, a film having different functions to the transparent resin film 10*b* is normally used as the transparent resin film 2*b*. However, films having similar functions may be used for the resin film 2*b* and the resin film 10*b*. To improve a shock resistance of the display main body 1, the transparent plate 2 is preferably constituted by the transparent glass 2*a* alone or by the transparent glass 2*a* and the transparent resin film 2*b* adhered to the surface thereof.

Figure 1B:
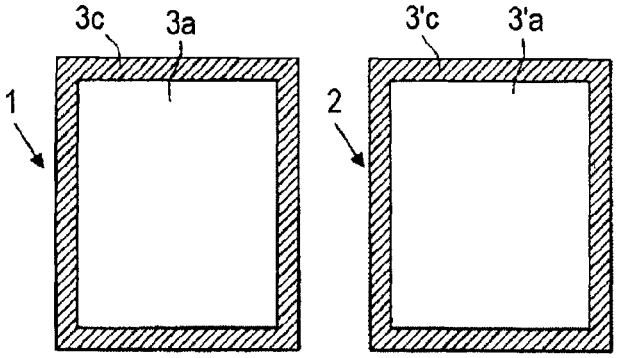
Figure 1C:
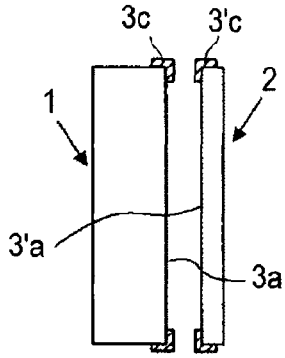

First, as shown in FIGS. 1A to 1C, surface treatment is implemented by applying surface treatment agents 3*c*, 3'*c*, for example, to the peripheral edge regions 3*b*, 3'*b* of the adhesion surfaces 3*a*, 3'*a* serving as respective single surfaces of the outer surface of the screen of the display main body 1 (an outer surface of the display plate 10) and the transparent plate 2. This surface treatment is performed to reduce a surface energy of the treated peripheral edge regions 3*b*, 3'*b* below a surface energy of regions of the adhesion surfaces 3*a*, 3'*a* other than the peripheral edge regions 3*b*, 3'*b* and below a surface energy of the adhesive 5 used during adhesion. Note that FIG. 1A is a plan view of the two adhesion surfaces 3*a*, 3'*a* prior to the surface treatment, FIG. 1B is a plan view of the two adhesion surfaces 3*a*, 3'*a* following the surface treatment, and FIG. 1C is a side view of the display main body 1 and the transparent plate 2 following the surface treatment. Further, shaded parts in FIGS. 1B and 1C indicate the applied surface treatment agents 3*c*, 3'*c* in pattern form.

As shown in the drawings, the surface treatment is preferably performed on the peripheral edge regions 3*b*, 3'*b* of both adhesion surfaces 3*a*, 3'*a* to prevent the adhesive 5 from spreading to the outside and ensuring that the adhesive 5 is distributed evenly between the adhesion surfaces 3*a*, 3'*a* not subjected to the surface treatment. However, the surface treatment may be performed on only one of the peripheral edge region 3*b* of the adhesion surface 3*a* forming the outer surface of the screen of the display main body 1 and the peripheral edge region 3'*b* of the adhesion surface 3'*a* forming one surface of the transparent plate 2. Even when the surface treatment is performed on only one of the adhesion surfaces 3*a*, 3'*a*, the adhesive 5 can be prevented from spreading to the outside and the adhesive 5 can be distributed evenly between the adhesion surfaces 3*a*, 3'*a* not subjected to the surface treatment. Further, the surface treatment performed on the peripheral edge regions 3*b*, 3'*b* of the adhesion surfaces 3*a*, 3'*a* need not be applied continuously to the peripheral edge regions 3*b*, 3'*b*, as shown by the respective regions of the surface treatment agents 3*c*, 3'*c* in FIG. 1B, and as long as the adhesive 5 can be prevented from spreading to the outside and the adhesive 5 can be distributed evenly, the treatment may be applied discontinuously. In other words, the surface treatment may be applied intermittently in a peripheral direction.

The surface treatment is performed by applying the surface treatment agents 3*c*, 3'*c*, which are fluorine-based or silicone-based, for example, to the peripheral edge regions 3*b*, 3'*b* of the adhesion surface 3*a* of the display main body 1 and the adhesion surface 3'*a* of the transparent plate 2. A typical printing method, partial spraying method, inkjet method, or similar may be used as the method of applying the surface treatment agents 3*c*, 3'*c*. Further, surface activation treatment such as UV ozone treatment, corona discharge treatment, or plasma discharge treatment is preferably implemented on the peripheral edge regions 3*b*, 3'*b* of the adhesion surface 3*a* of the display main body 1 and the adhesion surface 3'*a* of the transparent plate 2 before performing the surface treatment. By implementing this surface activation treatment, the adhesiveness of the surface treatment agents 3*c*, 3'*c* relative to the peripheral edge regions 3*b*, 3'*b* is improved.

Further, the surface treatment agents 3*c*, 3'*c* are selected in accordance with the materials of the adhesion surface 3*a* of the display main body 1 and the adhesion surface 3'*a* of the transparent plate 2. More specifically, when the adhesion surfaces 3*a*, 3'*a* of the display main body 1 and the transparent plate 2 are formed from glass and resin film, a surface energy value thereof is within a range of 40 to 60 dyne/cm. In this case, a surface energy value of the used surface treatment agents 3*c*, 3'*c* is preferably within a range of 18 to 31 dyne/cm to prevent the adhesive 5 from spreading and ensure that the adhesive 5 is distributed evenly between the adhesion surfaces 3*a*, 3'*a* not subjected to the surface treatment. For similar reasons, the surface energy value of the surface treatment agents 3*c*, 3'*c* is even more preferably within a range of 18 to 22 dyne/cm.

Furthermore, the surface treatment is preferably performed within a width range of 1 mm to 3 mm from end portions of the adhesion surfaces 3*a*, 3'*a* (end portions of the display plate 10 and the transparent plate 2) inward. By setting this width range, the effects of preventing the adhesive 5 from spreading, ensuring that the adhesive 5 is distributed evenly between the adhesion surfaces 3*a*, 3'*a* not subjected to the surface treatment, and improving the shock resistance of the display main body 1 can be obtained more easily. Further, as shown in FIGS. 1B and 1C, application regions of the surface treatment agents 3*c*, 3'*c*, or in other words surface treatment regions, need not be limited to the peripheral edge regions 3*b*, 3'*b* of the adhesion surfaces 3*a*, 3'*a* and may extend to respective side faces thereof (side faces of the display plate 10 and side faces of the transparent plate 2). Moreover, similar types of compounds are normally used as the surface treatment agents 3*c*, 3'*c* but different types of compounds may be used.

Next, as shown in FIG. 1C, the display main body 1 and the transparent plate 2 are disposed such that the respective adhesion surfaces 3*a*, 3'*a* oppose each other via a gap. FIG. 1C is a schematic sectional view showing a state in which the display main body 1 and the transparent plate 2 are disposed such that the respective adhesion surfaces 3*a*, 3'*a* oppose each other. A distance of the gap between the adhesion surface 3*a* of the display main body 1 and the adhesion surface 3'*a* of the transparent plate 2 is preferably set within a range of 50 μm to 500 μm in a part where the regions not subjected to the surface treatment oppose each other. By setting the distance of the gap within this range, waviness on the display plate 10 forming the adhesion surface 3*a* of the display main body 1 and waviness on the transparent plate 2 can be absorbed such that unevenness in the thickness of the adhesive 5 following adhesion is less obvious. Furthermore, an improvement in the shock resistance of the panel can be obtained more easily from the interposed adhesive 5 and a reduction in transmittance due to coloring caused by the adhesive 5 can be suppressed.

In this embodiment, the display main body 1 and the transparent plate 2 are disposed such that the adhesion surface 3*a* of the display main body 1 and the adhesion surface 3'*a* of the transparent plate 2 are parallel to each other. The adhesion surfaces 3*a*, 3'*a* are preferably both vertical but may be tilted.

In a case where the display main body 1 is a main body part of a flat panel display, the display main body 1 and the transparent plate 2 can be disposed opposite each other in the following manner, for example, as shown in FIG. 1C. First, the display main body 1 and the transparent plate 2 are held using a holding mechanism that holds a disposal subject by vacuum adsorption. The holding mechanism is formed, for example, by arranging a large number of rubber adsorption pads in matrix form on one surface of a lattice-shaped lightweight metal jig having profile irregularity. Next, a desired gap is set by measuring and adjusting the distance between the adhesion surfaces 3*a*, 3'*a* of the display main body 1 and the transparent plate 2 using a fine motion stage and a length measuring machine disposed in the four corners of the holding mechanism.

Figure 1D:
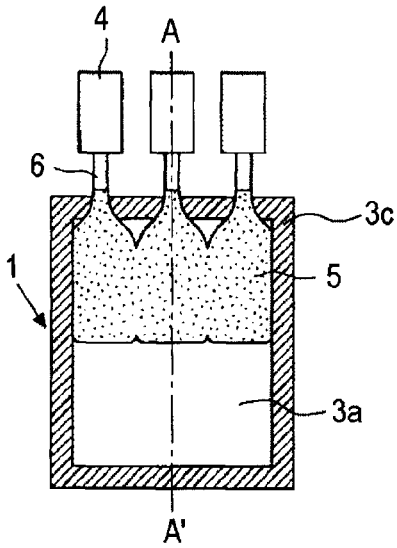
Figure 1E:
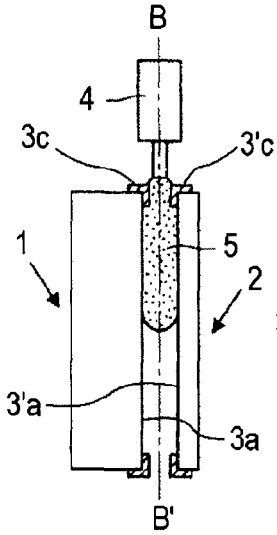

Next, as shown in FIGS. 1D and 1E, the display main body 1 and the transparent plate 2 are disposed such that the adhesion surfaces 3*a*, 3'*a* oppose each other via a gap, whereupon the adhesive 5 is injected into the gap from the dispenser 4. In this embodiment, the adhesive 5 is injected from an upper side of the gap. An internal discharge pressure of the dispenser 4 is preferably set within a range of 50 KPa to 200 KPa, and an injection pressure into the gap is preferably 0 KPa. In other words, once the adhesive 5 has been discharged from the nozzle 6, the adhesive 5 is distributed through the gap between the two adhesion surfaces 3*a*, 3'*a* gradually thereafter under its own weight and due to a capillary action of the gap. Note that FIG. 1E corresponds to an A-A' cross-section of FIG. 1D while FIG. 1D corresponds to a B-B' cross-section of FIG. 1E.

A thermosetting adhesive, a cold setting adhesive, a two liquid reactive adhesive, a UV setting adhesive, and so on may be used as the adhesive 5. When the transparent plate 2 is made from a material that transmits UV light, a UV setting adhesive is preferably used. Further, the surface treatment described above is performed such that the surface energy of the peripheral edge regions 3*b*, 3'*b* decreases below the surface energy of the adhesive 5 used during adhesion. In other words, the adhesive 5 is selected in accordance with the surface treatment agents 3*c*, 3'*c* used during the surface treatment such that the surface energy value thereof is greater than the surface energy value of the surface treatment agents 3*c*, 3'*c*. Moreover, as noted above, when glass and resin film are used as the materials of the adhesion surfaces 3*a*, 3'*a*, the surface energy value of the used adhesive 5 is preferably within a range of 36 to 47 dyne/cm. By setting the surface energy value within this range, the effects of preventing the adhesive 5 from spreading and ensuring that the adhesive 5 is distributed evenly between the adhesion surfaces 3*a*, 3'*a* not subjected to the surface treatment are obtained more easily. Furthermore, to improve the shock resistance of the display main body 1 and ensure that the adhesive 5 is distributed easily and evenly, a viscosity of the adhesive 5 is preferably within a range of 0.05 Pa·s to 10 Pa·s.

Injection may be performed by the dispenser 4 in one or a plurality of locations, but when a plurality of the nozzles 6 are used such that the adhesive 5 is injected from a plurality of locations at the same time, the injected adhesive 5 flows down through the gap in a curtain shape, thereby preventing air bubble entrainment, and therefore this method is preferable. Further, when the adhesive 5 is injected using a slit-form nozzle employed in a slit coater or the like such that the nozzle corresponds to a width of the upper side of the gap between the adhesion surfaces 3*a*, 3'*a*, the adhesive 5 can be injected in a smooth curtain shape without air bubble entrainment, and therefore this method is even more preferable. In these cases, the discharge pressure and injection pressure may be set as described above. More specifically, a tip end surface of the injected adhesive 5 sinks downward under its own weight, and therefore the adhesive 5 is preferably injected at a speed that allows replenishment of the injected amount.

The adhesive 5 may be injected by the dispenser 4 until the adhesive 5 has traveled over the entire region between the two adhesion surfaces 3*a*, 3'*a*, excluding the peripheral edge regions 3*b*, 3'*b*. However, the adhesive 5 is preferably injected in the following manner. Specifically, injection of the adhesive 5 is terminated before the adhesive 5 has traveled over the entire region between the adhesion surfaces 3*a*, 3'*a*, excluding the peripheral edge regions 3*b*, 3'*b*. The gap between the adhesion surfaces 3*a*, 3'*a* is then narrowed using the fine motion stages of the aforesaid holding mechanism. Thus, the adhesive 5 is pressed from either side, and as a result, the adhesive 5 can travel over the entire region between the adhesion surfaces 3*a*, 3'*a*, excluding the peripheral edge regions 3*b*, 3'*b*.

Figure 1F:
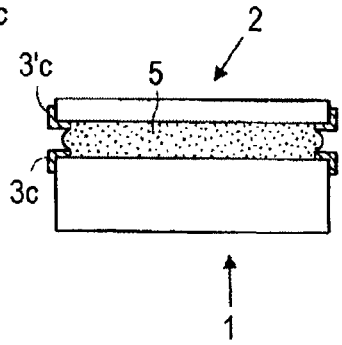

More preferably, the adhesive 5 is pressed by releasing the display main body 1 and the transparent plate 2 from the holding mechanism and turning the transparent plate 2 to face upward so that the two adhesion surface 3*a*, 3'*a* are held in a horizontal state, as shown in FIG. 1F. In other words, a pressing force generated by the weight of the transparent plate 2 can be exerted by turning the transparent plate 2 to face upward so that the two adhesion surfaces 3*a*, 3'*a* are horizontal. As a result, the adhesive 5 can be caused to travel over the entire region by means of a natural capillary action and the surface treatment implemented on the peripheral edge regions 3*b*, 3'*b* of the adhesion surfaces 3*a*, 3'*a* without applying excessive pressure to the display main body 1 and the transparent plate 2.

The injected adhesive 5 is typically distributed through the gap concentrically under its own weight, and therefore, when the adhesive 5 reaches the periphery of the adhesion surfaces 3*a*, 3'*a*, the adhesive 5 spreads out from this location. In this embodiment, however, the adhesive 5 is flicked back by the surface-treated peripheral edge regions 3*b*, 3'*b* of the adhesion surfaces 3*a*, 3'*a* during the distribution process, and therefore the adhesive 5 flows so as to fill the parts of the gap that are more easily wetted and as yet unfilled. Hence, the adhesive 5 travels over the entire region between the adhesion surfaces 3*a*, 3'*a* not subjected to the surface treatment naturally without spreading. The adhesive 5 is then hardened using a method corresponding to the employed adhesive 5, whereupon the adhesion operation is terminated.

Second Embodiment

As shown in FIGS. 3A to 3E, a second embodiment differs from the first embodiment in the process for injecting the adhesive 5. More specifically, in the first embodiment, the display main body 1 and the transparent plate 2 are disposed such that the adhesion surfaces 3*a*, 3'*a* are oriented in a vertical direction, whereupon the adhesive 5 is injected into the gap between the adhesion surfaces 3*a*, 3'*a* not subjected to the surface treatment under its own weight. In this embodiment, on the other hand, the display main body 1 and the transparent plate 2 are disposed such that the respective adhesion surfaces 3*a*, 3'*a* are horizontal, whereupon the adhesive 5 is injected by inserting a tip end of the nozzle 6 provided on the dispenser 4 into the gap between the two adhesion surfaces 3*a*, 3'*a*.

Figure 3A:
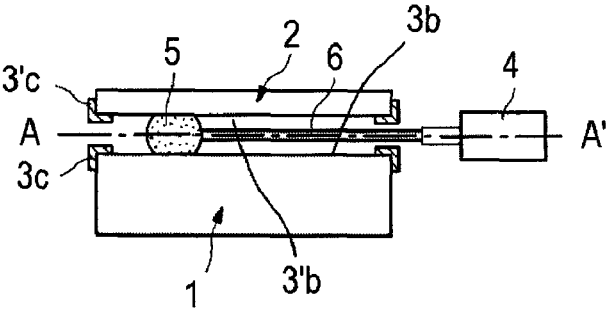
FIGS. 3A to 3E are schematic diagrams showing a process for adhering a transparent plate according to a second embodiment.
Figure 3B:
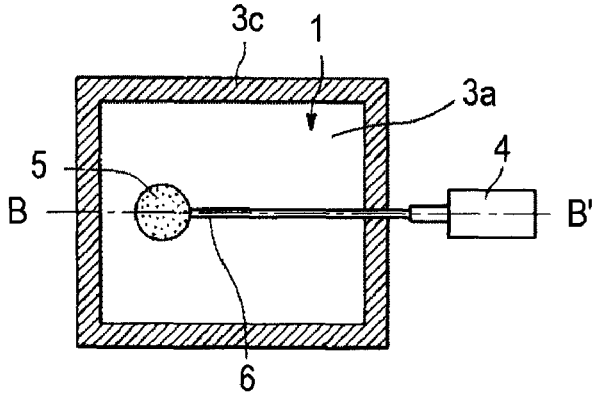

Likewise in this embodiment, as described with reference to FIGS. 1A and 1B, first, similar surface treatment to that of the first embodiment is implemented on the peripheral edge region 3*b* of the adhesion surface 3*a* of the display main body 1 and the peripheral edge region 3'*b* of the adhesion surface 3'*a* of the transparent plate 2. Next, using a similar holding mechanism to that of the first embodiment, for example, the display main body 1 and the transparent plate 2 are held such that the adhesion surfaces 3*a*, 3'*a* oppose each other via a desired gap. The distance of the gap between the two adhesion surfaces 3*a*, 3'*a* may be identical to that of the first embodiment for similar reasons. As shown in FIG. 3A, the holding mechanism holds the display main body 1 and the transparent plate 2 such that the respective adhesion surfaces 3*a*, 3'*a* thereof are horizontal. Next, as shown in FIGS. 3A and 3B, using a dispenser 4 having a nozzle 6 with an elongated tip end, the nozzle 6 is inserted into the gap between the respective adhesion surfaces 3*a*, 3'*a* of the display main body 1 and the transparent plate 2 while keeping the adhesion surfaces 3*a*, 3'*a* horizontal, whereupon injection of the adhesive 5 is begun. Note that FIG. 3B corresponds to an A-A' cross-section of FIG. 3A while FIG. 3A corresponds to a B-B' cross-section of FIG. 3B.

The nozzle 6 employed in this embodiment is narrower than the distance of the gap between the two adhesion surfaces 3*a*, 3'*a* and is connected to the dispenser 4 for use. The dispenser 4 and the nozzle 6 may be used singly or in pluralities. The adhesive 5 is preferably injected from a plurality of the nozzles 6 at the same time so that the adhesive 5 can be injected into the entire region of the gap on the inner side of the surface-treated peripheral edge regions 3*b*, 3'*b* efficiently and quickly. Note that a position of the tip end of the nozzle 6 at the start of the injection process is preferably set on a far side of the gap as seen from the dispenser 4, as shown in FIGS. 3A and 3B, so that the adhesive 5 can travel over the entire surface of the gap between the adhesion surfaces 3*a*, 3'*a* not subjected to the surface treatment more easily.

Figure 3C:
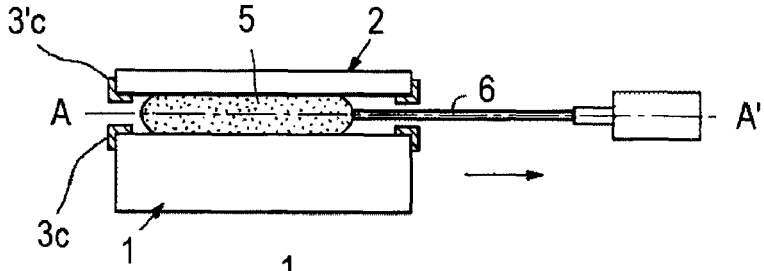
Figure 3D:
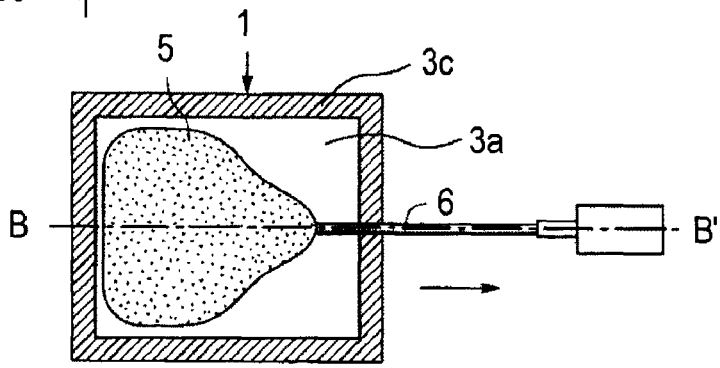
Figure 3E:
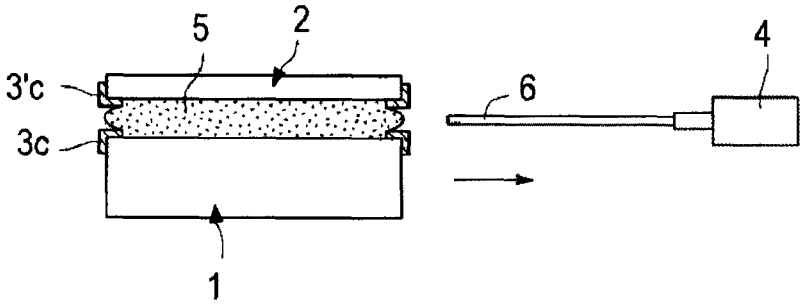

Next, as shown in FIGS. 3C and 3D, the adhesive 5 is injected and distributed to the extent that it does not spread from the end faces, and at the same time, the nozzle 6 is gradually withdrawn. Note that FIG. 3D corresponds to an A-A' cross-section of FIG. 3C while FIG. 3C corresponds to a B-B' cross-section of FIG. 3D. Finally, injection of the adhesive 5 from the nozzle 6 is terminated, whereupon the tip end of the nozzle 6 is removed from the gap, as shown in FIG. 3E.

The adhesive 5 may be injected by the dispenser 4 such that the adhesive 5 travels over the entire region of the adhesion surfaces 3*a*, 3'*a* of the display panel 1 on the inner side of the peripheral edge regions 3*b*, 3'*b* subjected to the surface treatment, but similarly to the first embodiment, the adhesive 5 is preferably injected in the following manner. Specifically, injection of the adhesive 5 is terminated before the adhesive 5 has traveled over the entire region between the adhesion surfaces 3*a*, 3'*a*, excluding the peripheral edge regions 3*b*, 3'*b*, whereupon the gap between the two adhesion surfaces 3*a*, 3'*a* is narrowed. Thus, pressure is applied to the adhesive 5, and as a result, the adhesive 5 can be caused to travel over the entire region of the gap between the adhesion surfaces 3*a*, 3'*a*, excluding the peripheral edge regions 3*b*, 3'*b*.

Further, as described in the first embodiment, the adhesive 5 is preferably pressed by turning the transparent plate 2 to face upward and releasing at least the transparent plate 2 from the holding mechanism. In other words, the pressing force generated by the weight of the transparent plate 2, a natural capillary action, and the surface treatment implemented on the peripheral edge regions 3*b*, 3'*b* work together to cause the adhesive 5 to travel favorably without applying excessive pressure.

Once the adhesive 5 has been caused to travel over the entire region of the adhesion surfaces 3*a*, 3'*a* on the inner side of the peripheral edge regions 3*b*, 3'*b* in this manner, the adhesive 5 is hardened using a method corresponding to the employed adhesive 5, whereupon the adhesion operation is terminated.

A display is manufactured by connecting a driving apparatus to the display main body in which the transparent plate 2 is adhered to the screen, as described in the two embodiments above, and mounting the resulting display main body in a case.

EXAMPLES

First and second examples will be described on the basis of FIGS. 1A to 1F, while third and fourth examples will be described on the basis of FIGS. 3A to 3E.

First Example

First, a face plate was prepared by forming a black light blocking member having a plurality of matrix-form opening portions, a fluorescent body positioned inside each opening portion, and an anode electrode covering a surface of the light blocking member and the fluorescent bodies on one surface of a 700 mm×1240 mm×thickness 2.5 mm soda-lime glass. Further, a rear plate was prepared by forming a plurality of row wirings and a plurality of column wirings, a plurality of field emission type electron-emitting devices connected to the wirings, and a plurality of spacers on one surface of a soda-lime glass of an identical size to the soda-lime glass described above. A glass frame was then attached to the periphery of the aforementioned surface of the rear plate, whereupon a frit glass was disposed on the frame. The face plate and the rear plate were then held in a vacuum atmosphere of $10^{-6}$ Pa such that the fluorescent bodies and the electron-emitting devices opposed each other, whereupon heat fusion was applied to the frit glass to join the face plate to the frame. As a result, a panel-shaped display main body 1 having a thickness of 8.0 mm was created.

Next, an anti-static transparent resin film was adhered to the outer surface of the screen of the display main body 1. The transparent resin film is a PET film in which a polyester resin (PET) coating layer through which ITO particles are dispersed is formed on a surface thereof, and the size of the transparent resin film is substantially equal to the size of the display plate constituting the screen of the display main body 1. The PET film was adhered to the outer surface of the screen of the display main body 1 using an acrylic adhesive. In this example, the display plate is constituted by the soda-lime glass forming the face plate and the anti-static transparent resin film, and the adhesion surface 3*a* of the display main body 1 is the PET coating layer through which ITO particles are dispersed.

Further, a soda-lime glass of an identical size to the display plate 10 of the display main body 1 was prepared, and an anti-reflection transparent resin film was adhered to one surface of the soda-lime glass. An acrylic resin layer through which silica microparticles are dispersed is formed on a PET film surface of the transparent resin film, and the size of the transparent resin film is substantially equal to the size of the soda-lime glass to which it is adhered. The PET film was adhered to the surface of the soda-lime glass using an acrylic adhesive. In this example, the transparent plate 2 is constituted by the soda-lime glass and the anti-reflection transparent resin film. The adhesion surface 3'*b* of the transparent plate 2 is the aforementioned glass surface.

Next, UV ozone treatment was implemented in a 2.0 mm width region extending inward from the four sides of the display plate forming the adhesion surface 3*a* of the display main body 1 and a 1.5 mm width region extending from the four sides to the side faces of the display plate. Next, a spraying method was employed to apply an alcohol-diluted solution of trifluoropropyl-trimethoxysilane (KBM-7103, manufactured by Shin-Etsu Silicones) as a surface treatment agent to the peripheral edge region 3*b* and side faces of the display plate subjected to the UV ozone treatment using a mask, whereupon the solution was dried. Similar treatment was performed on the peripheral edge region 3'*b* of the adhesion surface 3'a and the side faces of the transparent plate 2. Thus, the surface-treated peripheral edge regions 3b, 3'b and sides faces were formed on the display main body 1 and the transparent plate 2, respectively, as shown in FIGS. 1B and 1C. The surface energy of the polyester resin layer surface serving as the adhesion surface 3a of the display main body 1 was 42 dyne/cm, and the surface energy of the glass surface serving as the adhesion surface 3'b of the transparent plate 2 was 58 dyne/cm. Further, the surface energy of the peripheral edge regions 3b, 3'b of the two adhesion surfaces 3a, 3'a and the side faces subjected to the surface treatment was 20 dyne/cm.

Next, as shown in FIG. 1C, the display main body 1 and the transparent plate 2 were disposed using a holding mechanism such that the adhesion surface 3a of the display main body 1 opposed the adhesion surface 3'a of the transparent plate 2 and such that the two adhesion surfaces 3a, 3'a were parallel in the vertical direction.

First, a lattice-shaped aluminum jig having a large number of rubber adsorption pads arranged in matrix form on one surface thereof was adsorbed to the rear plate surface of the display main body 1. Meanwhile, a similar jig was adsorbed to the transparent resin film surface of the transparent plate. Then, using a fine motion stage and a length measuring machine connecting the four corners of the two jigs, the gap between the adhesion surface 3a of the display main body 1 and the adhesion surface 3'a of the transparent plate 2 was set at 300 μm.

Next, as shown in FIGS. 1D and 1E, seven dispensers 4 were disposed relative to an upper side (length 700 mm) of the gap between the adhesion surfaces 3a, 3'a of the display main body 1 and the transparent plate 2 in positions of 50 mm, 150 mm, 250 mm, 350 mm, 450 mm, 550 mm and 650 mm from one side. In this state, the tip ends of the nozzles 6 of the dispensers 4 were disposed in contact with the gap. Note that only three dispensers 4 are disposed in FIGS. 1D and 1E, but as described above, it is assumed that seven dispensers 4 are disposed.

The adhesive 5 was then injected into the gap between the adhesion surfaces 3a, 3'a of the display main body 1 and the transparent plate 2 from the upper side. An injection pressure was not set to be particularly strong at this time, and instead the adhesive 5 was allowed to fall under its own weight. The internal discharge pressure of the dispensers 4 was set at 100 KPa and the injection pressure into the gap was set at 0 KPa. An acrylic UV setting resin adhesive having a composition shown below in Table 1 was used as the adhesive 5. The surface energy of the adhesive 5 was 42 dyne/cm and the viscosity thereof was 800 mPa·s.

TABLE 1

| ADHESIVE COMPONENT | CONTENT |
|---|---|
| HYDROXYETHYL ACRYLATE | 30 MASS % |
| PENTAERYTHRITOL TRIACRYLATE | 25 MASS % |
| ACRYLATE OLIGOMER ("EBECRYL 745", MANUFACTURED BY DAICEL-CYTEC COMPANY LTD.) | 40 MASS % |
| 1-HYDROXY-CYCLOHEXYLPHENYLKETONE | 5 MASS % |

Injection of the adhesive 5 by the dispensers 4 was terminated at the point where the tip end of the injected adhesive 5 reached a position 5 mm from a lower side of the display plate and transparent plate 2. The entire holding mechanism was immediately disposed horizontally such that the transparent plate 2 faced upward, whereupon the holding mechanism was removed from the display main body 1 and the transparent plate 2. The display main body 1 and transparent plate 2 were then left in the horizontal state for two minutes to allow the adhesive 5 to travel over the entire region of the gap. Finally, 30 mW/cm$^2$ ultraviolet rays were applied from the transparent plate 2 side for four minutes to harden the adhesive 5, whereby adhesion of the transparent plate 2 to the outer surface of the screen of the display main body 1 was completed. Although the adhesive 5 extended to the peripheral edge regions 3b, 3'b of the two adhesion surfaces 3a, 3'a, no adhesive 5 was observed to have spread so as to smear the sides faces of the display plate on the display main body 1 and the side faces of the transparent plate 2. Moreover, no air bubbles were found in the injection region of the adhesive 5. Note that in this example, a plate material formed from a glass and an anti-reflection transparent resin film was used as the transparent plate, but a single glass plate may be used. In this case, the glass transparent plate 2 is adhered to the display plate surface of the display main body 1, whereupon an anti-reflection transparent resin film is adhered to the surface of the glass transparent plate 2.

Second Example

Similar surface treatment to that of the first example was implemented on the peripheral edge region 3b of the adhesion surface 3a of the display main body 1 and the side faces of the display plate forming the adhesion surface 3a, but not on the transparent plate 2. Otherwise, the display main body 1 and the transparent plate 2 were adhered to each other in a similar manner to the first example. The adhesive 5 spread slightly, but by wiping the spread adhesive 5 away before hardening the adhesive 5, it was possible to prevent the adhesive 5 from smearing the side faces of the display plate on the display main body 1 and the side faces of the transparent plate 2. Likewise in this example, no air bubbles were found in the injection region of the adhesive 5.

Third Example

Similar surface treatment to that of the first example was implemented on an identical display main body 1 and an identical transparent plate 2 to the first example, whereupon the display main body 1 and transparent plate 2 were held using a similar holding mechanism to the first example. Note that in this example, the gap between the two adhesion surfaces 3a, 3'a was set at 350 μm. The entire holding mechanism was then disposed such that the transparent plate 2 faced upward and the two adhesion surfaces 3a, 3'a were horizontal.

Next, five apparatuses formed by attaching an SUS304T capillary pipe (manufactured by FUJINO KINZOKU CO., LTD) having an outer diameter of ϕ300 μm, an inner diameter of ϕ150 μm and a length of 1000 mm to the dispenser 4 as the nozzle 6 were prepared. The five nozzles 6 were then arranged relative to the 700 mm short side of the gap between the two adhesion surfaces 3a, 3'a in positions of 100 mm, 225 mm, 350 mm, 475 mm and 600 mm from one side. The tip ends of the respective nozzles 6 were then inserted to a position of 950 mm inside the gap from the short side, as shown in FIGS. 3A and 3B, whereupon injection of the adhesive 5 was begun. In this example, the internal discharge pressure of the dispensers 4 was set at 500 KPa and the injection pressure into the gap was set at 0 KPa. The same adhesive as that of the first example was used as the adhesive 5. Although only one dispenser 4 is disposed in FIGS. 3A and 3B, it is assumed that five dispensers 4 are disposed, as noted above. The adhesive 5 injected from the tip ends of the five nozzles 6 gradually traveled through the gap, and at a point immediately before the tip end of the adhesive 5 reached the far short side, the nozzles 6 were gradually withdrawn together with the dispensers 4 while continuing to inject the adhesive 5.

At a point where the position of the adhesive 5 among the nozzles 6 of the dispensers 4 reached a position 10 mm away from the short side, injection was terminated and the nozzles 6 were removed from the gap. The holding mechanism was then immediately released from the display 1 and the transparent plate 2. The display main body 1 and the transparent plate 2 were then left in the horizontal state for two minutes to allow the adhesive 5 to travel over the entire region of the gap. Finally, 30 mW/cm$^2$ ultraviolet rays were applied from the transparent plate 2 side for four minutes to harden the adhesive 5, whereby adhesion of the transparent plate 2 to the outer surface of the screen of the display main body 1 was completed. Although the adhesive 5 extended to the peripheral edge regions 3*b*, 3'*b* of the two adhesion surfaces 3*a*, 3'*a*, no adhesive 5 was observed to have spread so as to smear the sides faces of the display plate and the side faces of the transparent plate 2. Moreover, no air bubbles were found in the injection region of the adhesive 5.

Fourth Example

Similar surface treatment to that of the first example was implemented on the peripheral edge region 3*b* of the adhesion surface 3*a* of the display main body 1 and the side faces of the display plate forming the adhesion surface 3*a*, but not on the transparent plate 2. Otherwise, the display main body 1 and the transparent plate 2 were adhered to each other in a similar manner to the third example. The adhesive 5 spread slightly, but by wiping the spread adhesive 5 away before hardening the adhesive 5, it was possible to prevent the adhesive 5 from smearing the side faces of the display plate on the display main body 1 and the side faces of the transparent plate 2. Likewise in this example, no air bubbles were found in the injection region of the adhesive 5.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-241597, filed on Oct. 20, 2009, which is hereby incorporated by reference herein in its entirety.

What is claimed is:

1. A manufacturing method for a display in which a transparent plate is adhered to an outer surface of a screen provided on a display main body, comprising the steps of:

setting the outer surface of the screen of the display main body and one surface of the transparent plate as respective adhesion surfaces;

performing a surface treatment at a peripheral edge region of one or both of the adhesion surfaces such that a surface energy of the peripheral edge region is smaller than a surface energy of a remaining region of the two adhesion surfaces and a surface energy of an adhesive used in the adhesion;

disposing the display main body and the transparent plate such that the two adhesion surfaces oppose each other via a gap; and injecting the adhesive into the gap, wherein the surface treatment is performed within a width range of 1 mm to 3 mm from the edge regions of the adhesion surfaces.

2. The manufacturing method for a display according to claim 1, wherein the surface treatment is performed on the peripheral edge regions of the two adhesion surfaces.

3. The manufacturing method for a display according to claim 1, wherein the display main body and the transparent plate are disposed such that the two adhesion surfaces are vertical, and the adhesive is injected from an upper side of the gap.

4. The manufacturing method for a display according to claim 2, wherein the display main body and the transparent plate are disposed such that the two adhesion surfaces are vertical, and the adhesive is injected from an upper side of the gap.

5. The manufacturing method for a display according to claim 2, wherein a surface treatment is performed on side faces of the transparent plate and the outer surface of the screen.

6. A manufacturing method for a display in which a transparent plate is adhered to an outer surface of a screen provided on a display main body, comprising the steps of:

setting the outer surface of the screen of the display main body and one surface of the transparent plate as respective adhesion surfaces;

performing a surface treatment at a peripheral edge region of at least one of the adhesion surfaces such that a surface energy of the treated peripheral edge region is smaller than a surface energy of a remaining region of the two adhesion surfaces and a surface energy of an adhesive used in the adhesion;

disposing the display main body and the transparent plate such that the two adhesion surfaces oppose each other via a gap; and injecting the adhesive into the gap.

7. The manufacturing method for a display according to claim 6, wherein the surface treatment is performed on peripheral edge regions of the two adhesion surfaces.

8. The manufacturing method for a display according to claim 6, wherein the display main body and the transparent plate are disposed such that the two adhesion surfaces are vertical, and the adhesive is injected from an upper side of the gap.

9. The manufacturing method for a display according to claim 7, wherein the display main body and the transparent plate are disposed such that the two adhesion surfaces are vertical, and the adhesive is injected from an upper side of the gap.

10. The manufacturing method for a display according to claim 7, wherein a surface treatment is performed on side faces of the transparent plate and the outer surface of the screen.

* * * * *